US009675154B2

(12) United States Patent
Tong

(10) Patent No.: US 9,675,154 B2
(45) Date of Patent: Jun. 13, 2017

(54) COMPOUND SUITCASE

(71) Applicant: Joy Tong, Boca Raton, FL (US)

(72) Inventor: Joy Tong, Boca Raton, FL (US)

( * ) Notice: Subject to any disclaimer, the term of this patent is extended or adjusted under 35 U.S.C. 154(b) by 192 days.

(21) Appl. No.: 14/598,209

(22) Filed: Jan. 15, 2015

(65) Prior Publication Data

US 2016/0206069 A1 Jul. 21, 2016

(51) Int. Cl.

| | |
|---|---|
| ***A45C 13/36*** | (2006.01) |
| ***A45C 5/02*** | (2006.01) |
| *A45C 5/03* | (2006.01) |
| *A45C 5/14* | (2006.01) |

(52) U.S. Cl.

CPC ..... *A45C 13/36* (2013.01); *A45C 5/02* (2013.01); *A45C 5/03* (2013.01); *A45C 5/14* (2013.01); *A45C 2005/035* (2013.01)

(58) Field of Classification Search

CPC .. A45C 13/36; A45C 5/03; A45C 5/14; A45C 13/262; A45C 2005/035; A45C 2013/267

See application file for complete search history.

(56) References Cited

U.S. PATENT DOCUMENTS

| | | | | | |
|---|---|---|---|---|---|
| 5,482,147 | A * | 1/1996 | Wang | A45C 5/14 | 190/115 |
| 5,566,797 | A | 10/1996 | Van Himbeeck | | |
| 5,943,936 | A | 8/1999 | Deliman et al. | | |
| 6,003,646 | A * | 12/1999 | Paudler | A45C 3/001 | 190/124 |
| 6,076,641 | A * | 6/2000 | Kinzer | A45C 5/14 | 16/18 CG |
| 6,109,404 | A * | 8/2000 | Bishop | A45C 5/14 | 190/115 |
| 6,119,835 | A * | 9/2000 | Lin | A45C 5/14 | 190/115 |
| 6,148,973 | A * | 11/2000 | Chang | A45C 5/14 | 190/115 |
| 6,220,412 | B1 | 4/2001 | Lin | | |
| 6,276,501 | B1 | 8/2001 | Tong | | |
| 6,283,261 | B1 * | 9/2001 | Sher | A45C 5/14 | 190/122 |
| 6,883,654 | B2 | 4/2005 | Godshaw et al. | | |
| 7,140,479 | B2 | 11/2006 | Mangano et al. | | |
| 7,147,089 | B2 | 12/2006 | Godshaw et al. | | |
| 2014/0311844 | A1 * | 10/2014 | Meersschaert | A45C 5/02 | 190/122 |

* cited by examiner

*Primary Examiner* — Tri Mai

(74) *Attorney, Agent, or Firm* — The Concept Law Group, P.A.; Scott D. Smiley; Yongae Jun

(57) ABSTRACT

A compound suitcase includes a top cover and a base which are formed with a plastic material by injection. The periphery of the top cover is formed with a side wall. The periphery of the base is formed with a side wall. Support units are connected at four corners of the top cover and the base, respectively. Each support unit includes a support board and a support member coupled to the support board. A covering fabric surrounds the outer surfaces of the four support units to form a front surface, two side surfaces, and a rear surface. The upper and lower ends of the front surface, the two side surfaces, and the rear surface are connected to the top cover and the base, respectively. The upper and lower portions of the compound suitcase are hard case configurations, and the middle portion is a soft case configuration.

19 Claims, 5 Drawing Sheets

COMPOUND SUITCASE

BACKGROUND OF THE INVENTION (a) Field of the Invention

The present invention relates to a suitcase, and more particularly to a compound suitcase having a hard configuration and a soft configuration.

(b) Description of the Prior Art

Traditional suitcases come in two modes. One is a whole hard case made of a plastic material, as disclosed in U.S. Pat. No. 5,943,936. The other is a soft case made of a soft material, as disclosed in U.S. Pat. Nos. 7,147,089, 7,140,479, 6,883,654, 6,276,501, and 6,220,412.

The whole hard case can prevent the suitcase from being pressed and damaged. However, the suitcase is not provided with secondary bags. It is not convenient for the user to store small articles. The soft case can be provided with a bag by means of a zipper for the user to store small articles conveniently. However, the structure is not sufficiently strong. The fabric at the four corners may suffer a lot of wear and tear.

Furthermore, the suitcase made of soft fabrics needs the procedure of sewing the top and the bottom with the inner lining and the outer fabric of the front, the sides, and the rear. After sewing the top and the bottom, the other parts are assembled or sewn. For example, the rear side of the top is coupled with a retractable handle. The middle of the top is provided with an upper handle. The bottom is provided with rollers and support protrusions. The parts are connected to the case by rivets or sewing. The assembly procedure is more complicated.

A developed suitcase is composed of a hard plastic board and soft fabrics, as disclosed in U.S. Pat. No. 5,566,797. However, its top and bottom both have a single plank configuration, so the strength of the structure is weaker. The single plank configuration may be compressed to warp or deform, therefore the capavity of the suitcase to bear the external pressure is limited. In particular, when used as a boarding suitcase, the four corners of the top and the bottom can suffer wear and tear easily to damage the fabric at the four corners. In U.S. Pat. No. 5,566,797, the top and the bottom are hard plastic boards. But, the back board used as a support is a single hard plastic board. Because the capacity of the structure to bear the upper pressure is limited, it cannot be applied to a large-sized suitcase.

Accordingly, the inventor of the present invention has devoted herself with many years of practical experience to solve these problems.

SUMMARY OF THE INVENTION

The primary object of the present invention is to provide a compound suitcase which is composed of a hard top configuration, a hard bottom configuration, and a middle soft fabric to overcome the shortcomings of a hard-case suitcase and a soft-case suitcase. The compound suitcase has the advantages of the hard-case suitcase and the soft-case suitcase and simplifies its assembly.

Another object of the present invention is to provide a compound suitcase which has support units provided between the hard case configuration and the soft case configuration to improve the strength of the conventional soft-case suitcase so that the suitcase with the soft fabric has a higher compressive configuration.

A further object of the present invention is to provide a compound suitcase which has a holder connected between support units so that the structure of the suitcase is more stable.

DETAILED DESCRIPTION OF THE PREFERRED EMBODIMENTS

Embodiments of the present invention will now be described, by way of example only, with reference to the accompanying drawings.

Figure 1:
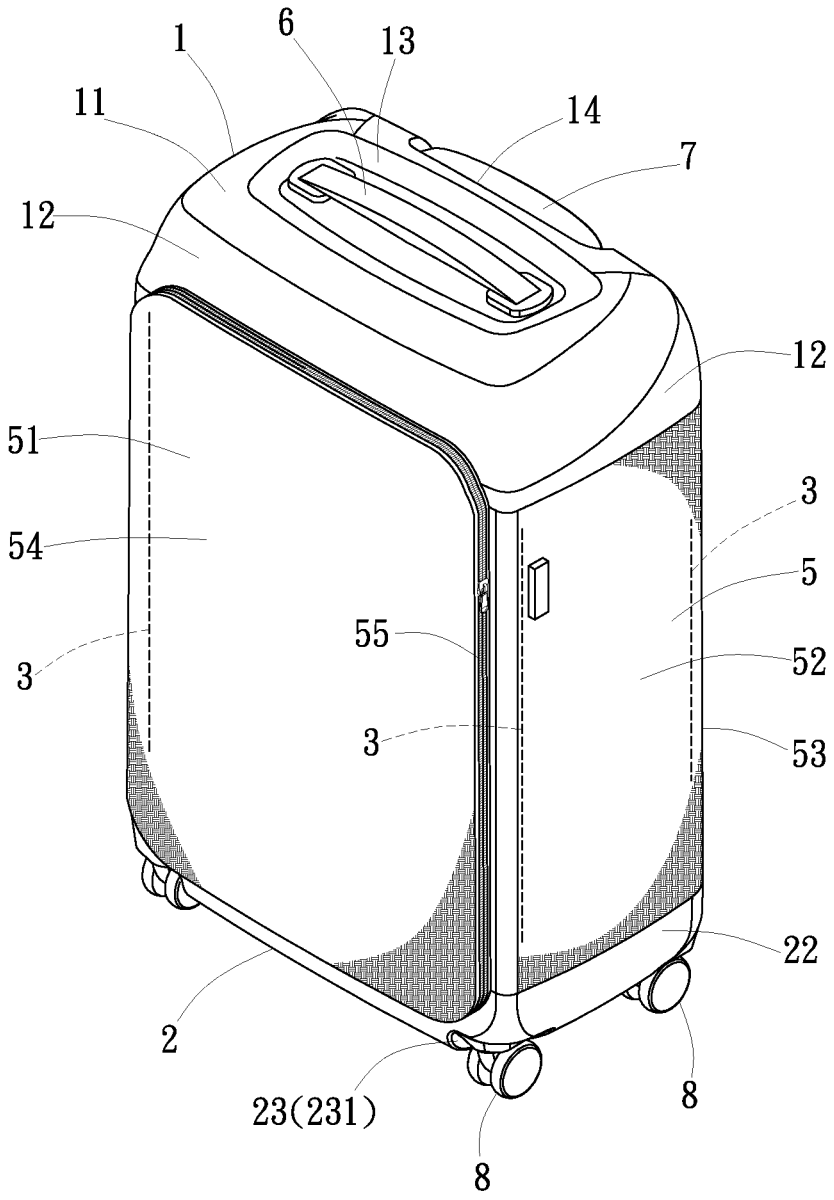
FIG. 1 is a perspective view of the suitcase according to a preferred embodiment of the present invention.

As shown in FIG. 1, the compound suitcase according to a preferred embodiment of the present invention comprises a top cover 1, a base 2, four support units 3, and a covering fabric 5. The top cover 1 may be provided with an upper handle 6 and a retractable handle 7. The bottom of the base 2 is provided with a plurality of rollers 8.

Figure 2:
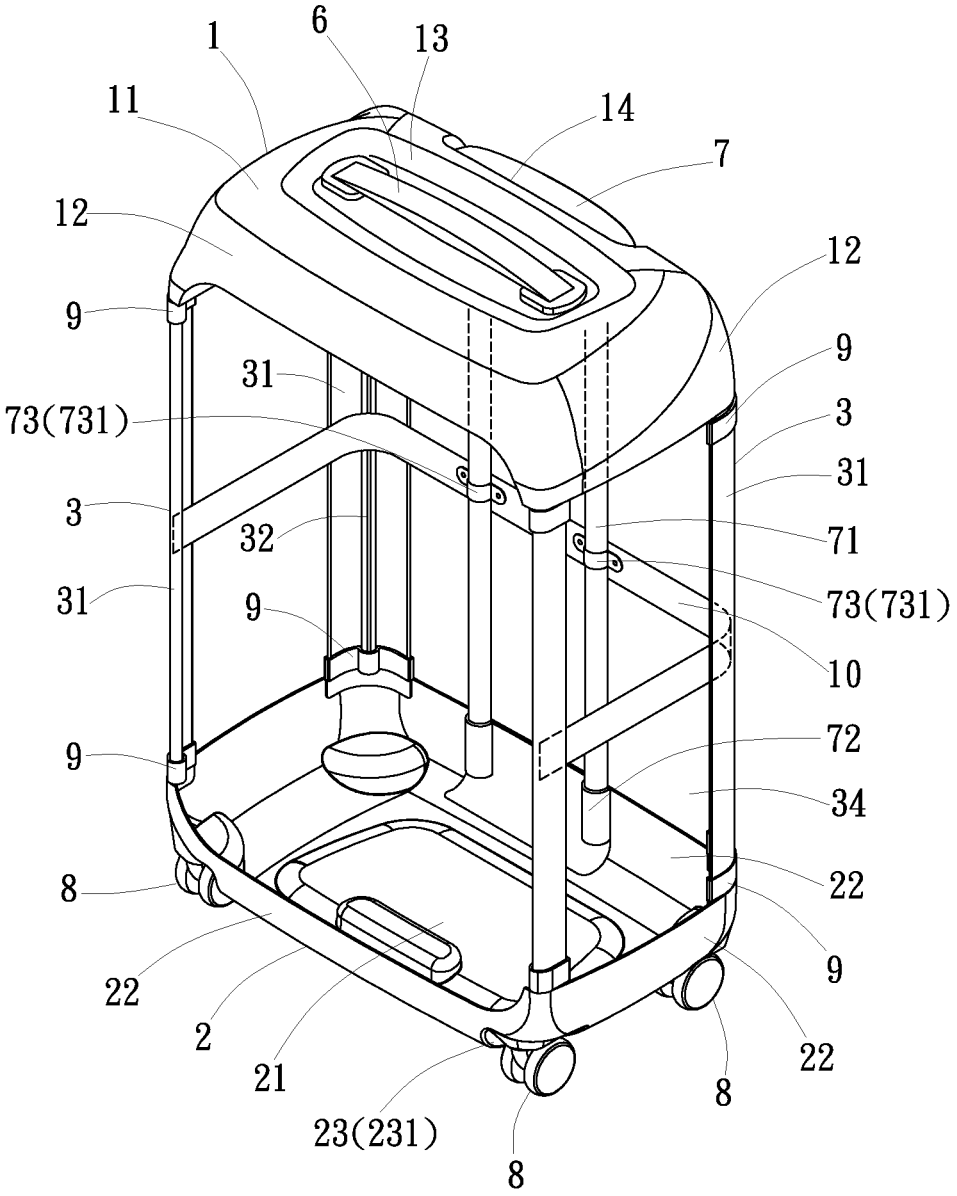
FIG. 2 is a perspective view of the hard configuration of the suitcase according to the present invention.

The top cover 1, as shown in FIG. 2, is a reverse U-shaped suitcase top configuration which is formed with polycarbonate (PC) or other plastic material by injection. The top cover 1 has a rectangular top surface 11, an upper side wall 12 integrally formed with the periphery of the top surface 11, an upper recess portion 13 integrally formed with the top surface 11, and a handle accommodation portion 14. The upper recess portion 13 is a curved shallow trough. The upper handle 6 is disposed on the upper recess portion 13. The handle accommodation portion 14 is a trough close to the back of the suitcase. The retractable handle 7 is disposed at the handle accommodation portion 14 for the user to adjust the retractable handle 7 by himself/herself.

The base 2, as shown in FIG. 2, is a U-shaped suitcase bottom configuration which is formed with polycarbonate (PC) or other plastic material by injection. The base 2 has a rectangular bottom surface 21, a lower side wall 22 integrally formed with the periphery of the bottom surface 21, and a plurality of roller coupling portions 23 at the corners of the base surface 21. The roller coupling portions 23 are lower recess portions 231 formed at four corners of the bottom surface 21. Each of the lower recess portions 231 is coupled with a roller 8.

Figure 3:
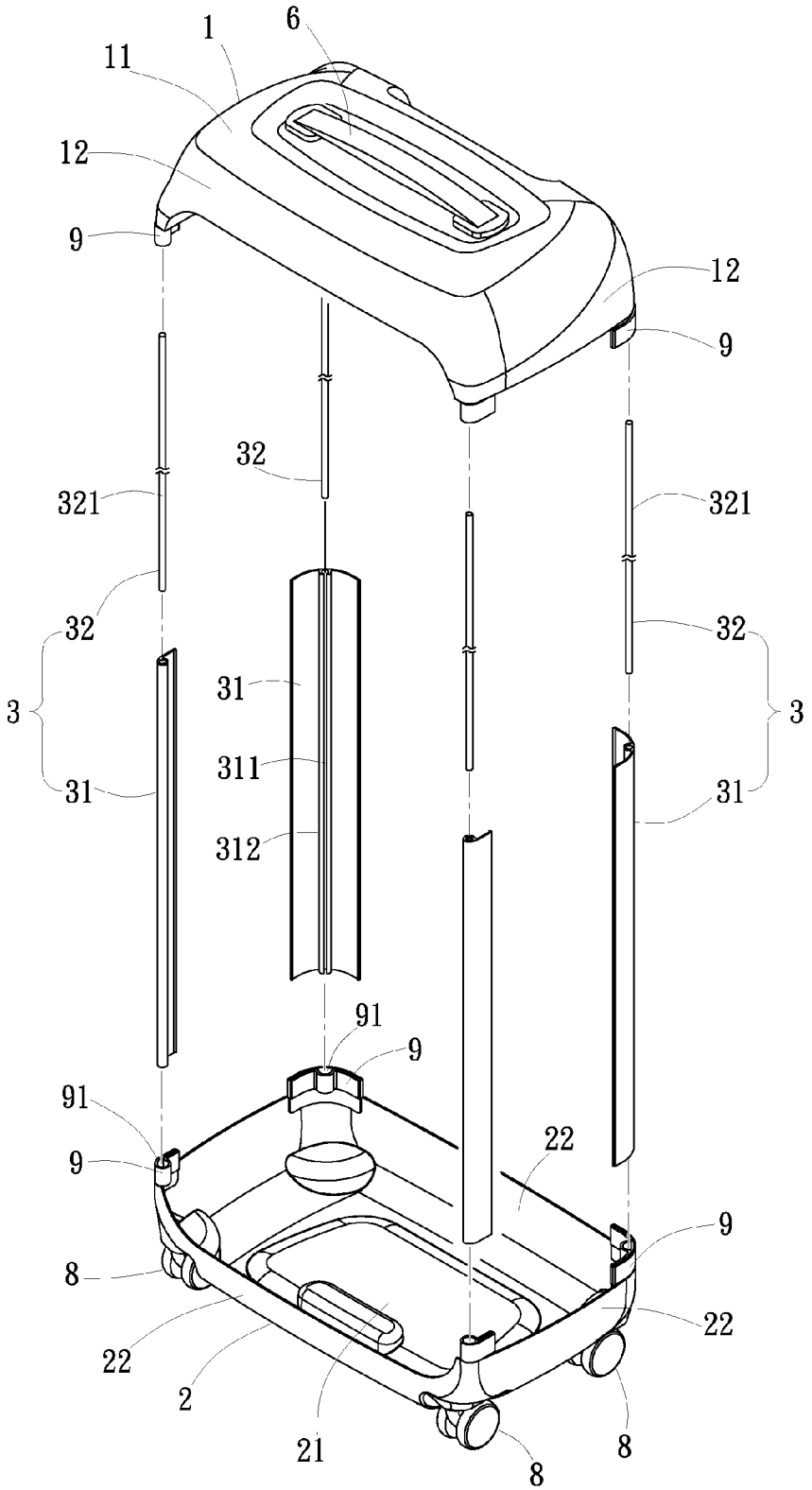
FIG. 3 is an exploded view of the hard configuration of the suitcase of the present invention.

The four support units 3, as shown in FIG. 2 and FIG. 3, are respectively connected at the four corners of the upper side wall 12 of the top cover 1 and the lower side wall 22 of the base 2. The top cover 1, the base 2, and the support units 3 are assembled to form the main structure of the suitcase. A hollow portion 34 is defined between every two of the support units 3. Preferably, each support unit 3 comprises a straight support board 31 and a support member 32 coupled to the support board 31. Thus, the suitcase has a better compressive strength.

The covering fabric 5, as shown in FIG. 1, is sewn with a textile fabric to surround the outer surfaces of the support boards 31 of the four support units 3 and to cover the hollow portions 34 between the support units 3. The covering fabric 5 has a front surface 51, two side surfaces 52, and a rear surface 53. The upper ends of the front surface 51, the two side surfaces 52, and the rear surface 53 are connected to the upper side wall 12 of the top cover 1, and the lower ends of the front surface 51, the two side surfaces 52, and the rear surface 53 are connected to the lower side wall 22 of the base 2. The front surface 51 can be a suitcase lid 54 to be opened and closed again and again. Preferably, the suitcase lid 54 is connected with the covering fabric 5 through a zipper 55, so that the suitcase lid 54 can be opened and closed again and again.

Through the design of the top cover 1, the base 2, the four support units 3, and the covering fabric 5, the top and the bottom of the compound suitcase of the present invention are to form hard case configurations, and the front face, the two side faces and the rear face are to form a soft case configuration. The top cover 1 is configured to a reverse U shape and the base 2 is configured to a U shape, so they won't be deformed by pressing. This can enhance the structural strength of the suitcase, making the upper four corners and the lower four corners of the suitcase durable enough to prevent breakage. Furthermore, the four support units 3 are connected between the top cover 1 and the base 2 to support the top cover 1 and the base 2 so as to provide a pressure-resistant effect. The four support units 3 are also to prop the covering fabric 5 flat.

As shown in FIG. 2, the present invention further comprises a holder 10 connected to the two sides and the back of the suitcase. Preferably, the holder 10 is a U-shaped slab. The holder 10 is connected to the middle portions of the four support units 3, such that the four support units 3 are more stable. Furthermore, the retractable handle 7 has two retractable rods 71, two rod seats 72 connected to the bottom ends of the two retractable rods 71, and fastening members 73 for fixing the two retractable rods 71 to the holder 10. The bottom ends of the two retractable rods 71 extend to the base 2. The rod seats 72 are coupled to the base 2. Preferably, the fastening members 73 are fastening plates 731 in Ω shape or other shape. The fastening members 73 are attached to the retractable rods 71, and then the fastening plates 731 are fixed to the holder 10 with rivets or bolts. Through connection of the retractable rods 7 and the holder 10, the suitcase is steady.

Figure 4:
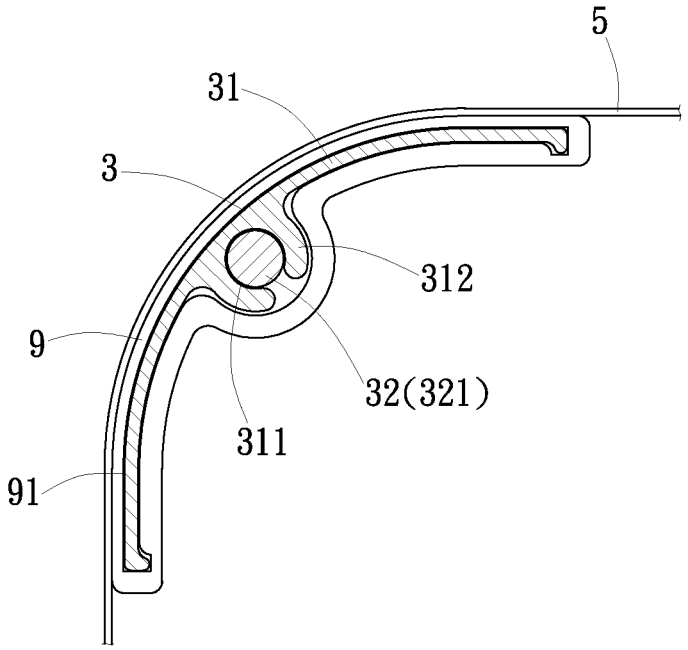
FIG. 4 is a sectional view of the support unit of the suitcase according to the present invention.
Figure 5:
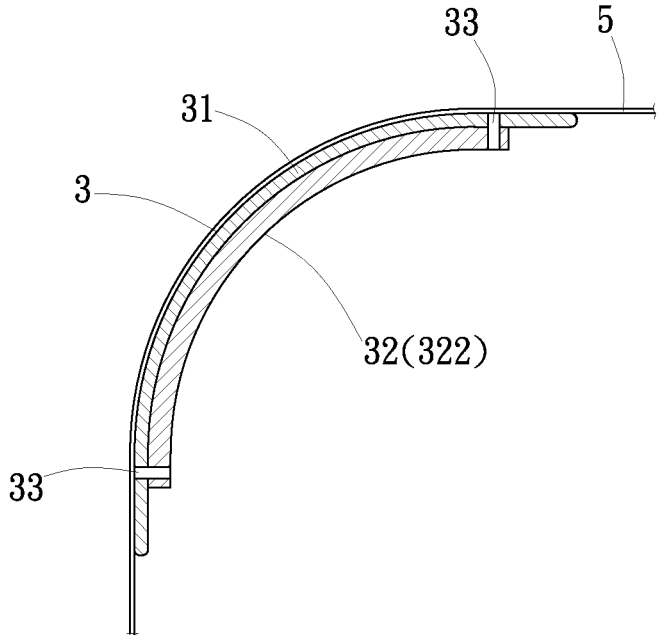
FIG. 5 is a sectional view of another embodiment of the support unit of the suitcase according to the present invention.

As shown in FIG. 3 and FIG. 4, preferably, the support boards 31 of the support units 3 are plastic boards each with a curved cross-section. The support boards 31 can be formed with polypropylene (PP) or other plastic material by injection. Preferably, the inner surface of the support board 31 is formed with a groove 311. The groove 311 can be formed in the center of a C-shaped buckle 312 of the support board 31 to enhance the ability of bending for the support board 31. The support member 32 is a support rod 321 inserted in the groove 311. The support rod 321 can be a plastic rod or a metallic rod. As shown in FIG. 5, the inner surface of the support board 31 is not provided with the groove 311. The support member 32 is a plastic plate 322 with a curved cross-section. The support member 32 is attached to the inner surface of the support board 31. The support member 32 and the support board 31 are connected through a plurality of fasteners 33. This also provides a support function.

Figure 6:
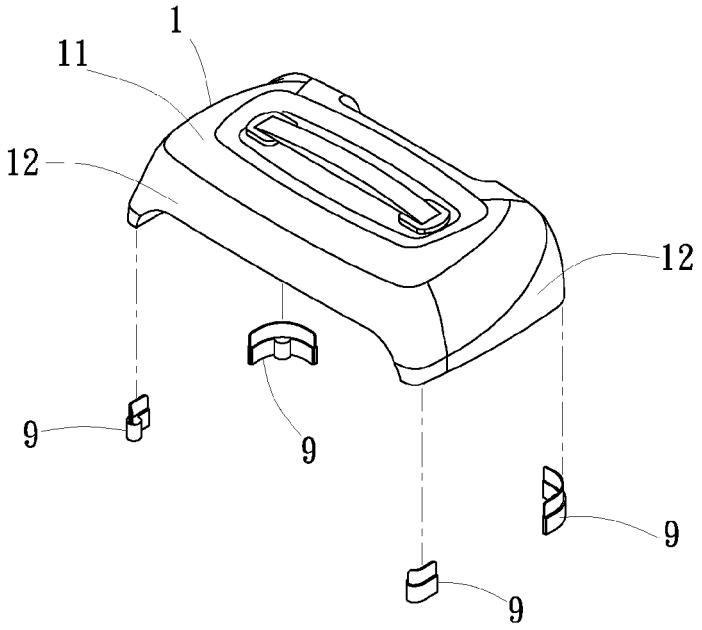
FIG. 6 is an exploded view showing the top cover and the connecting members of the suitcase according to the present invention.
Figure 7:
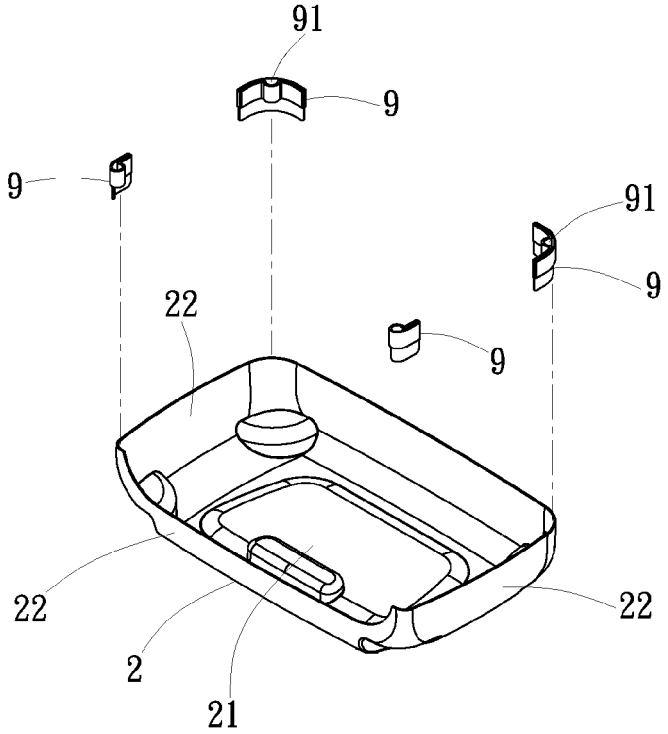
FIG. 7 is an exploded view showing the base and the connecting members of the suitcase according to the present invention.

As shown in FIG. 3, the lower end of the upper side wall 12 of the top cover 1 and the upper end of the lower side wall 22 of the base 2 are provided with four connecting members 9, respectively. The connecting members 9 can be integrally formed with the top cover 1 and the base 2, as shown in FIG. 3, alternatively, the connecting members 9 can be mounted to the top cover 1 and the base 2, as shown in FIG. 6 and FIG. 7. Thus, two ends of each support board 31 and two ends of each support member 32 of the support units 3 are connected to the connecting members 9, respectively. Referring to FIG. 4, the end surface of each connecting member 9 is formed with an engaging trough 91. The two ends of each support board 31 and the two ends of each support member 32 are engaged with the engaging troughs 91 of the corresponding connecting members 9. Through the aforesaid configuration, the top cover 1, the base 2, and the four support units 3 of the suitcase of the present invention can be assembled quickly, and then fitted with the covering fabric 5. This way can enhance the assembly efficiency of the suitcase.

Besides, the covering fabric 5 is sewn with a fabric. One of the front surface 51, the two side surfaces 52, and the rear surface 53 is provided with an auxiliary bag (not shown in the drawings). The auxiliary bag can be provided with a zipper or without a zipper. Compared to the conventional hard suitcase, the suitcase of the present invention has multiple storage spaces for the user to classify the articles.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A compound suitcase, comprising a top cover, a base, four support units, and a covering fabric, the top cover having a rectangular top surface, an upper side wall integrally formed with a periphery of the top surface, an upper recess portion integrally formed with the top surface, and a handle accommodation portion, the base having a rectangular bottom surface, a lower side wall integrally formed with a periphery of the bottom surface, and a plurality of roller coupling portions at corners of the base surface, the four support units being respectively connected at four corners of the upper side wall of the top cover and the lower side wall of the base, a hollow portion being defined between every two of the support units, the support units each comprising a support board and a support member coupled to the support board, the covering fabric surrounding outer surfaces of the four support units and covering the hollow portions between the support units, the covering fabric having a front surface, two side surfaces, and a rear surface, upper ends of the front surface, the two side surfaces, and the rear surface being connected to the upper side wall of the top cover, lower ends of the front surface, the two side surfaces, and the rear surface being connected to the lower side wall of the base, the front surface being provided with a suitcase lid able to be opened and closed repeatedly, and a lower end of the upper side wall of the top cover and an upper end of the lower side wall of the base being provided with four connecting members respectively, and two ends of each support board and two ends of each support member of the support units being connected to the connecting members respectively.

2. The compound suitcase as claimed in claim 1, wherein each of the support boards is a plastic plate with a curved cross-section.

3. The compound suitcase as claimed in claim 2, wherein an inner surface of each of the support boards is formed with a groove, and each of the support members is a support rod inserted in the groove.

4. The compound suitcase as claimed in claim 2, wherein the support member is a plastic plate with a curved cross-section, the support member is attached to an inner surface of the support board, and the support member and the support board are connected through a plurality of fasteners.

5. The compound suitcase as claimed in claim 1, wherein each of the connecting members is formed with an engaging trough, and the two ends of each support board and the two ends of each support member are engaged with the engaging troughs of the corresponding connecting members.

6. The compound suitcase as claimed in claim 1, wherein one of the front surface, the two side surfaces, and the rear surface is provided with an auxiliary bag.

7. The compound suitcase as claimed in claim 1, wherein the upper recess portion of the top cover is provided with an upper handle, and the handle accommodation portion of the top cover is provided with a retractable handle.

8. The compound suitcase as claimed in claim 1, wherein the roller coupling portions are lower recess portions formed at four corners of the base, and each of the lower recess portions is coupled with a roller.

9. The compound suitcase as claimed in claim 1, further comprising a holder, the holder being a U-shaped slab connected to two sides and a back of the suitcase, the holder being connected to middle portions of the four support units, a retractable handle having two retractable rods, two rod seats connected to bottom ends of the two retractable rods, and fastening members for fixing the two retractable rods to the holder, the bottom ends of the two retractable rods extending to the base, the rod seats being coupled to the base, the fastening members being fastening plates, the fastening members being attached to the retractable rods, the fastening plates being fixed to the holder with rivets or bolts.

10. A compound suitcase, comprising a top cover, a base, four support units, and a covering fabric, the top cover having a rectangular top surface, an upper side wall integrally formed with a periphery of the top surface, an upper recess portion integrally formed with the top surface, and a handle accommodation portion, the base having a rectangular bottom surface, a lower side wall integrally formed with a periphery of the bottom surface, and a plurality of roller coupling portions at corners of the base surface, the four support units being respectively connected at four corners of the upper side wall of the top cover and the lower side wall of the base, a hollow portion being defined between every two of the support units, the support units each comprising a support board and a support member coupled to the support board, the covering fabric surrounding outer surfaces of the four support units and covering the hollow portions between the support units, the covering fabric having a front surface, two side surfaces, and a rear surface, upper ends of the front surface, the two side surfaces, and the rear surface being connected to the upper side wall of the top cover, lower ends of the front surface, the two side surfaces, and the rear surface being connected to the lower side wall of the base, the front surface being provided with a suitcase lid able to be opened and closed repeatedly, and the holder being a U-shaped slab connected to two sides and a back of the suitcase, the holder being connected to middle portions of the four support units, the retractable handle having two retractable rods, two rod seats connected to bottom ends of the two retractable rods, and fastening members for fixing the two retractable rods to the holder, the bottom ends of the two retractable rods extending to the base, the rod seats being coupled to the base, the fastening members being fastening plates, the fastening members being attached to the retractable rods, and the fastening plates being fixed to the holder with rivets or bolts.

11. The compound suitcase as claimed in claim 10, wherein each of the support boards is a plastic plate with a curved cross-section.

12. The compound suitcase as claimed in claim 10, wherein an inner surface of each of the support boards is formed with a groove, and each of the support members is a support rod inserted in the groove.

13. The compound suitcase as claimed in claim 10, wherein the support member is a plastic plate with a curved cross-section, the support member is attached to an inner surface of the support board, and the support member and the support board are connected through a plurality of fasteners.

14. The compound suitcase as claimed in claim 10, wherein each of the connecting members is formed with an engaging trough, and the two ends of each support board and the two ends of each support member are engaged with the engaging troughs of the corresponding connecting members.

15. A compound suitcase, comprising a top cover, a base, four support units, a covering fabric, a holder, and a retractable handle, the top cover having a rectangular top surface, an upper side wall integrally formed with a periphery of the top surface, an upper recess portion integrally formed with the top surface, and a handle accommodation portion, the base having a rectangular bottom surface, a lower side wall integrally formed with a periphery of the bottom surface, and a plurality of roller coupling portions at corners of the base surface, the four support units being respectively connected at four corners of the upper side wall of the top cover and the lower side wall of the base, a hollow portion being defined between every two of the support units, the support units each comprising a support board and a support member coupled to the support board, the covering fabric surrounding outer surfaces of the four support units and covering the hollow portions between the support units, the covering fabric having a front surface, two side surfaces, and a rear surface, upper ends of the front surface, the two side surfaces, and the rear surface being connected to the upper side wall of the top cover, lower ends of the front surface, the two side surfaces, and the rear surface being connected to the lower side wall of the base, the front surface being provided with a suitcase lid able to be opened and closed repeatedly, and each support board and each support member of the four support units extending from a connecting member disposed at a lower end of the upper sidewall of the top cover to a corresponding connecting member disposed at an upper end of the lower side wall of the base.

16. The compound suitcase as claimed in claim 15, wherein each of the support boards is a plastic plate with a curved cross-section.

17. The compound suitcase as claimed in claim 15, wherein an inner surface of each of the support boards is formed with a groove, and each of the support members is a support rod inserted in the groove.

18. The compound suitcase as claimed in claim 15, wherein the support member is a plastic plate with a curved cross-section, the support member is attached to an inner surface of the support board, and the support member and the support board are connected through a plurality of fasteners.

19. The compound suitcase as claimed in claim 15, wherein each of the connecting members is formed with an engaging trough, and the two ends of each support board and the two ends of each support member are engaged with the engaging troughs of the corresponding connecting members.

* * * * *